US010971861B2

(12) United States Patent
Gzybowski

(10) Patent No.: US 10,971,861 B2
(45) Date of Patent: Apr. 6, 2021

(54) POLARIZED ELECTRICAL PLUG AND ADAPTOR WITH MODULAR ORIENTATION VERIFICATION

(71) Applicant: Michael S. Gzybowski, Ann Arbor, MI (US)

(72) Inventor: Michael S. Gzybowski, Ann Arbor, MI (US)

( * ) Notice: Subject to any disclaimer, the term of this patent is extended or adjusted under 35 U.S.C. 154(b) by 335 days.

(21) Appl. No.: 15/888,805

(22) Filed: Feb. 5, 2018

(65) Prior Publication Data

US 2018/0248315 A1 Aug. 30, 2018

Related U.S. Application Data

(60) Provisional application No. 62/463,197, filed on Feb. 24, 2017.

(51) Int. Cl.

| | |
|---|---|
| ***H01R 13/641*** | (2006.01) |
| ***H01R 13/64*** | (2006.01) |
| ***H01R 13/46*** | (2006.01) |
| ***H01R 13/642*** | (2006.01) |
| *H01R 24/28* | (2011.01) |
| *H01R 103/00* | (2006.01) |

(52) U.S. Cl.

CPC ..... *H01R 13/641* (2013.01); *H01R 13/465* (2013.01); *H01R 13/64* (2013.01); *H01R 13/642* (2013.01); *H01R 24/28* (2013.01); *H01R 2103/00* (2013.01)

(58) Field of Classification Search

CPC ..... H01R 13/641; H01R 13/642

USPC ..... 439/490, 491, 489

See application file for complete search history.

(56) References Cited

U.S. PATENT DOCUMENTS

| | | | | |
|---|---|---|---|---|
| 4,861,288 A * | 8/1989 | Friedman | H01R 13/405 | 439/736 |
| 5,306,164 A * | 4/1994 | Hollander | H01R 13/652 | 439/103 |
| 5,620,335 A * | 4/1997 | Siemon | H01R 13/46 | 439/447 |
| 5,637,017 A * | 6/1997 | Hsu | H01R 13/68 | 337/198 |
| 5,641,310 A * | 6/1997 | Tiberio, Jr. | H01R 13/625 | 439/680 |
| 6,539,530 B1 * | 3/2003 | Torii | G06F 17/5077 | 716/127 |
| 7,474,460 B2 * | 1/2009 | Fujiwara | H04B 10/2587 | 359/237 |
| 7,651,365 B2 * | 1/2010 | Chien | H01R 13/6691 | 439/490 |
| D675,168 S * | 1/2013 | Yass | D13/170 | |

(Continued)

FOREIGN PATENT DOCUMENTS

| | | |
|---|---|---|
| GB | 2045546 A * | 3/1979 |
| GB | 2251985 A * | 12/1991 |

*Primary Examiner* — Harshad C Patel

(57) ABSTRACT

Modular two-prong polarized electrical plugs and plug adaptors provided with indicia modules that can be inserted into recesses on the plug housings and adaptor bodies. The indicia modules include indicia elements. By inserting the indicia modules on the proper sides of the plug housings or adaptor bodies, the tops of the plugs and adaptors can be readily identified for purposes of verifying the orientation of the plugs and plug adaptors when and after plugging them into electrical outlets.

6 Claims, 4 Drawing Sheets

(56) References Cited

U.S. PATENT DOCUMENTS

| | | | | |
|---|---|---|---|---|
| 8,734,178 | B2 * | 5/2014 | Inagaki | H01R 13/5808 439/369 |
| D749,046 | S * | 2/2016 | Curry | H01R 13/516 D13/133 |
| D796,440 | S * | 9/2017 | Gzybowski | D13/138.1 |
| 2005/0023026 | A1 * | 2/2005 | Chen | H01R 13/641 174/74 R |
| 2012/0045926 | A1 * | 2/2012 | Lee | H01R 13/6691 439/488 |
| 2015/0255915 | A1 * | 9/2015 | Kao | H01R 24/28 439/606 |
| 2015/0340826 | A1 * | 11/2015 | Chien | A61L 9/03 439/490 |
| 2015/0372432 | A1 * | 12/2015 | Hagemeier | H01R 13/641 439/490 |
| 2016/0006178 | A1 * | 1/2016 | Gzybowski | H01R 13/465 439/491 |

* cited by examiner

FIG. - 7
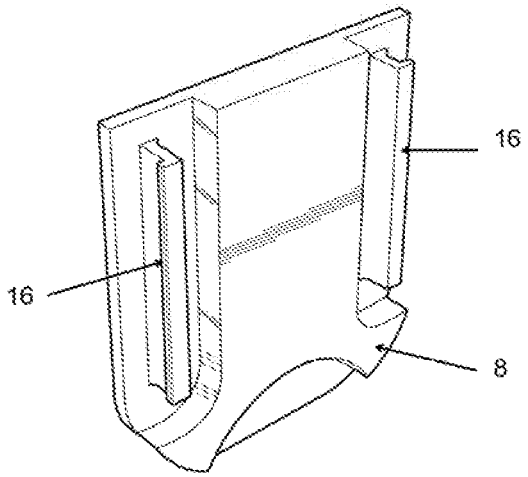
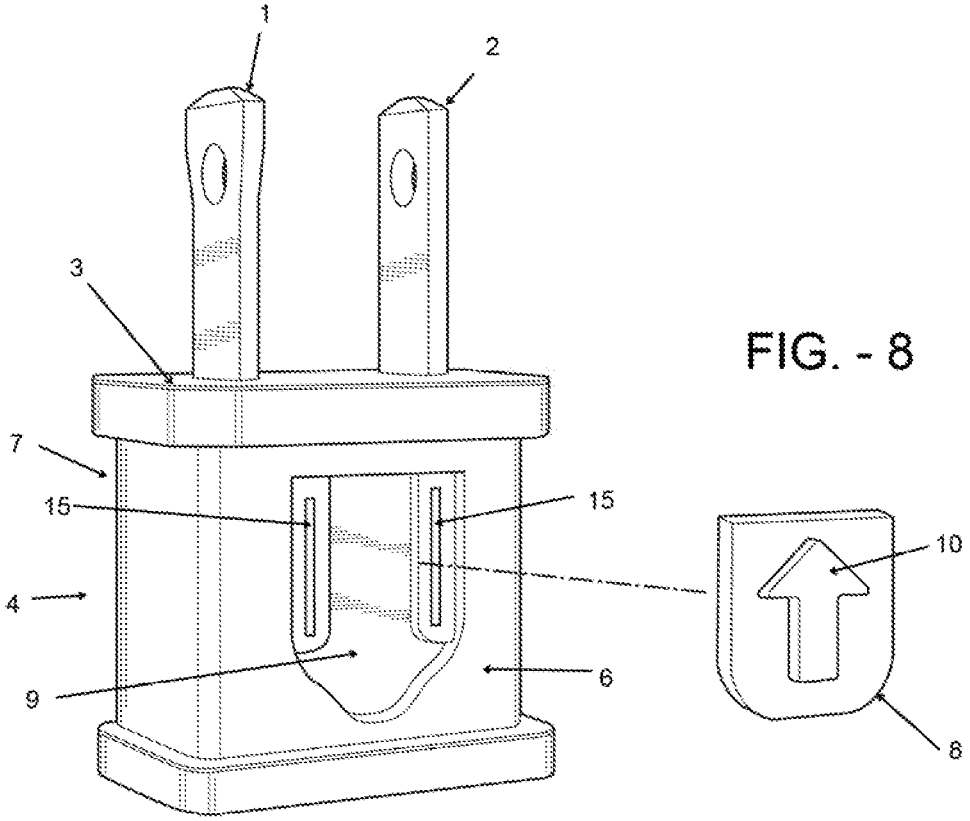
FIG. - 8

POLARIZED ELECTRICAL PLUG AND ADAPTOR WITH MODULAR ORIENTATION VERIFICATION

RELATED APPLICATION

This application is based upon U.S. Provisional Patent Application Ser. No. 62/463,197, filed Feb. 24, 2017 to which priority is claimed under 35 U.S.C. § 120 and of which the entire specification is hereby expressly incorporated by reference.

BACKGROUND

The present inventor has filed U.S. Non-Provisional patent application Ser. No. 14/709,713 on May 12, 2015 which is directed to marking the tops of two-prong polarized electrical plugs, U.S. Non-Provisional patent application Ser. No. 14/971,042 on Dec. 16, 2015 which is directed to two-prong polarized electrical polarized plug adaptors having marked tops, and U.S. Non-Provisional patent application Ser. No. 15/344,531 on Nov. 6, 2016 which is directed to top marked two-prong polarized electrical plug adaptors that are configured to resist being pulled downward and out of an electrical receptacle or outlet. The entire specifications of each of these prior filed applications are hereby expressly incorporated by reference.

The plugs and plug adaptors disclosed in the inventor's prior non-provisional applications listed above provide features and advantages over the prior art and satisfy a long felt need. Nevertheless they present a significant challenge that involves having consumers who purchase and use the plugs and adaptors chose the correct plugs and adaptors to use in instances where the ground sock of a particular electrical outlet is oriented downward or upward. Such orientation of outlets determines which surface of a plug or adaptor will be the top when oriented to and plugged into the outlet.

While this issue can be addressed by offering for sale a selection of plugs and adaptors that have different surfaces marked with indicia and educating/guiding consumers as to which type of plug/adaptor to purchase and use for any particular outlet orientation, it would be more economical to be able to manufacture one style of plug/adaptor.

Accordingly the present invention provides universal or modular plugs and adaptors that include housings or bodies that are configured to receive indicia modules (also referred to herein as "modular indicia inserts") in or on opposite surfaces of the housings or bodies so as to mark the surface which will be the top surface when the plugs and adaptors are plugged into an electrical outlet or receptacle.

BRIEF SUMMARY

According to various features, characteristics and embodiments of the present invention which will become apparent as the description thereof proceeds, the present invention provides for polarized electrical plugs and polarized plug adaptors that include modular indicia components that allow the configuration of the indicia to be determined and set by consumers at the time the plugs and adaptors are used.

The present invention thus allows consumers to buy modular plugs and adaptors that are all the same (to simplify manufacturing) and configure the indicia on the plugs and adaptors when they are put into use.

In particular the present invention provides a modular two-prong polarized electrical plug that provides for visual confirmation of proper orientation with respect to a polarized electrical receptacle or outlet before and after being plugged into the outlet which comprises:

a plug housing having a top and a bottom and a front face;

an electrically conductive polarized prong or blade that extends outward from front face of the plug housing;

an electrically conductive non-polarized prong or blade that extends outward from the front face of the plug housing; and an indicia module having an indicia element provided thereon which indicial module is configured to be attached to indicia module receiving structures provided on both the top and bottom of the plug housing.

The present invention further provides a modular polarized electrical plug adaptor configured to be coupled to a polarized two-prong electrical plug which polarized electrical plug adaptor provides for visual confirmation of proper orientation with respect to a polarized electrical receptacle or outlet before and after being plugged into the outlet and which polarized electrical plug adaptor comprises:

a body having a top and a bottom and a front and a back;

an electrically conductive polarized prong or blade that extends outward from the front of the body;

an electrically conductive non-polarized prong or blade that extends outward from the front of the body;

a polarized socket provided in the back of the body;

a non-polarized socket provided in the back of the body, said polarized socket and non-polarized socket being configured to receive a two-prong polarized electrical plug therein;

electrical conductive elements within the body that connect the polarized socket to the polarized prong or blade and connect the non-polarized socket to the non-polarized prong or blade; and an indicia module having an indicia element provided thereon which indicia module is configured to be attached to indicia module receiving structures provided on both the top and bottom of the body.

The present invention also provides a kit for marking the top of a two-prong polarized electrical plug which comprises:

a two-prong polarized electrical plug that includes:

a plug housing having a top and a bottom and a front face;

an electrically conductive polarized prong or blade that extends outward from front face of the plug housing; and an electrically conductive non-polarized prong or blade that extends outward from the front face of the plug housing; and at least one indicia module having an indicial element provided thereon which at least one indicial module is configured to be attached to indicia module receiving structures provided on both the top and bottom of the plug housing.

BRIEF DESCRIPTION OF THE DRAWINGS

The present invention will be described with reference to the attached drawings which are given as non-limiting examples only, in which:

FIG. 7 is a perspective view of an indicia module of FIGS. 4 and 6.

FIG. 8 is perspective view of a modular two-prong polarized electrical plug adaptor and an indicia module according to another embodiment of the present invention.

DETAILED DESCRIPTION OF THE DRAWINGS AND THE PRESENTLY PREFERRED EMBODIMENTS

Figure 1:
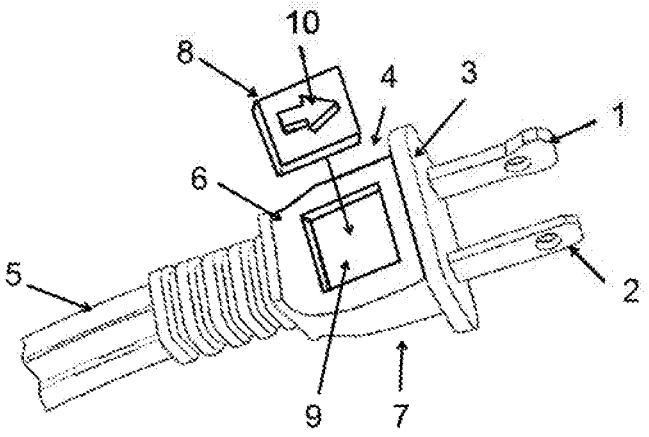
FIG. 1 is a prospective view of a modular two-prong polarized electrical plug according to one embodiment of the present invention.

Generally the two-prong polarized electrical plug of FIG. 1 has a similar overall shape as a standard two-prong polarized electrical plug. The plug includes a polarized prong or blade 1 and a non-polarized prong or blade 2 extending outward from a front face 3 of the plug housing 4 (also referred to as the plug body herein). An electrical cord 5 extends out from the rear of the plug housing 4 and can be connected to an electrical appliance or electrical device or opposite to the outlet end of an extension cord (not shown). The prongs or blades 1 and 2 can be made from any conventional conductive metal such as brass and the plug housing 4 can be made (e.g. molded as a one-piece solid structure) from any conventional non-conductive material such as a plastic material. The electrical cord 5 comprises a two conductor cord with each conductor coupled to one of the polarized and non-polarized prongs or blades 1 and 2 within the plug housing 4 in a conventional manner.

The top 6 and bottom 7 of the plug housing 4 have substantially identical or similar shapes or appearances. As such, as discussed below the indicia modules of the present invention are used to mark which of the top and bottom of the plug housing 4 will be located to face upward when the plug is plugged into or aligned to be plugged into a particular electrical outlet or receptacle typically mounted in a wall. Since the thicknesses and lengths of the prongs or blades 1 and 2 are the same, absent the indicia modules of the present invention, the entire electrical plug including the plug housing 4 and prongs or blades 1 and 2, looks virtually the same from the top and bottom planar views. As a result one cannot determine the orientation of the electrical plug of FIG. 1 as regards the polarized and non-polarized prongs or blades 1 and 2 by merely looking towards the top or bottom of the plug—absent the indicia modules of the present invention. Moreover absent the indicia modules of the present invention one cannot readily confirm that a plug that has been previously inserted into an outlet or receptacle was/is proper oriented for safety purposes prior to being inserted.

According to the present invention an indicia module 8 is provided which can be received and inserted into a recess 9 formed on (or in) the top (or bottom) of the plug housing 4 which functions to confirm the orientation of the polarized plug both while inserting the polarized plug into a polarized outlet receptacle and to enable confirmation of proper orientation after the polarized plug has been inserted into a polarized electrical outlet or receptacle, for example when a prior user has inserted the plug into an electrical outlet or receptacle. Reference herein to "insert," or "inserting" is not intended to limit how the indicia modules are coupled to the plug (or plug adaptor) housing or bodies. In this regard, as described herein the indicia modules can be received into recesses provided in or on the plug (or plug adaptor) housings or bodies, or coupled to structures that project from the plug (or plug adaptor) housings or bodies or attached on a non-recessed, non-projecting surface area of the plug (or plug adaptor) housings or bodies.

The indicia module 8 depicted in FIG. 1 includes an indicia element 10 that is in the shape of an arrow that points toward the direction where the prongs or blades 1 and 2 extend from the plug housing 4. The arrow can be the same or a different color than the plug housing 4 so as to be easy to visually determine or recognize by most people. For example the plug housing 4 can be white and the arrow (or entire indicia module) can be red, blue, black or some other color that is easily seen when compared to another color of the plug housing. That is the plug housing can generally be one color overall such as white and the indicia can be a different color such as red, blue, black, etc. or multicolored.

The indicia element can be a dyed or colored portion of the indicia module that is molded with a colored insert piece or is a colored portion of the indicia module. Otherwise the indicia element can be molded or printed or coated on the indicia module or provided as a permanent label, sticker, decal, or the like provided on or laminated on or in the indicia module. In one embodiment the indicia element can be laminated on the surface of the indicia module or laminated in a recess formed in the indicia module.

The plug housing 4 can include similar recesses 9 in both the top and bottom surfaces of the plug housing. While the recess 9 in FIG. 1 is shown as having a rectangular or square shape, it is to be understood that the recess(es) 9 can have any convenient shape, including a pattern of multiple discrete recesses that receive portions, such as pins or tabs, of the indicia modules.

The indicia module 8 has a similar shape to the recess(es) 9 and is configured to be received into the recess(es) 9. In this regard the indicia module 8 can be press-fit into recess 9 or have any suitable engaging structure(s) along the bottom or edges to engage sufficiently in the recess 9 or cooperating structures in the recess so as not to be easily removed or fall out. In some embodiments an adhesive substance such as a glue, epoxy, etc. can be used to secure the indicia module 8 in recess 9. The indicia module 8 can be molded from the same material as the plug housing 4 or otherwise manufactured of a similar or different material. Those skilled in the art will understand that any cooperating structures between the indicia modules and recesses such as press-fit, interference fit, engaging pins, etc. can be used. In alternative embodiments the recesses 9 can be replaced with projecting structures that engage cooperating receiving structures on or in the indicia modules 8. In even further embodiments the recesses 9 could be replaced with flat surface areas and the indicia modules 8 can be permanent labels, stickers, decals, or the like that are flat or have projecting or two- or three-dimensional indicia elements that can be applied with or without additional adhesive means. Engaging structures which allow for removal of the indicia modules will allow reconfiguration of the indicia and replacement of one type/style of indicia module for another as a user may desire or changing which surface the indicia module 8 is attached to.

By providing the plug housing 4 and indicia modules 8 as separate elements, consumers can purchase the two-prong polarized electrical plug of FIG. 1 and then determine what type of electrical outlet to plug the electrical plug into—one with the ground socket at the bottom or at the top—and after confirming which surface of the plug body 4 will be the "top" surface when plugged into the electrical outlet, the consumer can insert the indicia module 8 into the recess 9 that will be in the top of the plug housing 4. A blank indicia module can be inserted into the opposite surface for aesthetic purposes.

As can be appreciated the present invention relieves manufacturers from having to make separate two-prong polarized electrical plus with permanent pre-affixed/provided indicia on one side or the other side of the plug housings or bodies for electrical outlets with difference ground socket configurations.

Further the present invention will avoid and overcome any mistakes consumers might make in purchasing a two-prong polarized electrical plug having permanently affixed/provided indicia on the wrong surface for a given electrical outlet configuration/orientation.

It is to be understood that the shape of the indicia element 10 shown in FIG. 1 is for non-limited illustrative purposes only and the shape of the indicia element 10 is not limited to an arrow as shown.

In other embodiments the indicia element 10 can have any shape such as a circle, star, plus sign, etc. or be other words like "UP" or "TOP." Further the indicia element 10 can comprise any word or any symbol, logo, or pattern, including a single line or plurality of lines. In some embodiments the indicia elements 10 can be configured to provide some sense of direction required to insert a plug into an outlet. Words, arrows and non-symmetrical shaped indicia elements 10 can be used for this purpose.

The indicia elements 10 described above can be used individually or in combination. For example indicia elements that are recessed in or project from the top surface of an indicia module can be used as well as those that are the same or a different color than the indicia module 8 or plug housing or body 4. Or a combination of an indicia element that is recessed in part and projects in part from the top surface of an indicial module could be used. These are non-limited examples of combinations that those skilled in the art can easily expand upon based upon the present description.

The indicia element used in the present invention can be of a size and configuration to be easily seen from a distance of 6-8 feet or more which will allow one to be able to visibly verify the orientation of a plug after it has been plugged into an electrical outlet or receptacle from a standing position. In this regard if the color of the indicia and plug housing are not the same a dimension of the indicia about 5 mm or larger for a solid indicia or about 25% or greater of a corresponding dimension of the plug housing and about 33% or greater of a corresponding dimension of the plug housing will be easily visible. In the case of an indicia that is not solid, such as a line drawing or a projecting or recessed lines or a line drawing, if the width of the lines are at least 2 mm or greater with the overall shape of any line drawing being about 25% or greater of a corresponding dimension of the plug housing and about 33% or greater of a corresponding dimension of the plug housing, or even about 50% or greater they will be easily visible. In some embodiments the overall shape of the indicia is different from the overall shape of the plug housing. In further embodiments the indicia element is laminated into or onto the indicia module or otherwise attached to the indicia module and can include two- and three-dimensional indicia. Examples of three-dimensional indicia include real and synthetic gems including gem stickers or any small three-dimensional object.

The two-prong electrical plugs and plug adaptors of the present invention are particularly safe for use by young children who will not have to be concerned with handing the prongs or blades trying to determine the polarized prong or blade from the non-polarized prong or blade. Further the use of recessed or projecting indicia can be particularly useful for persons with poor eyesight or blind and in poor lighting conditions in conjunction with electrical outlets or receptacles that are difficult to access, such as behind furniture or under tables. It is even within the scope of the present invention to provide brail as indicia.

Figure 2:
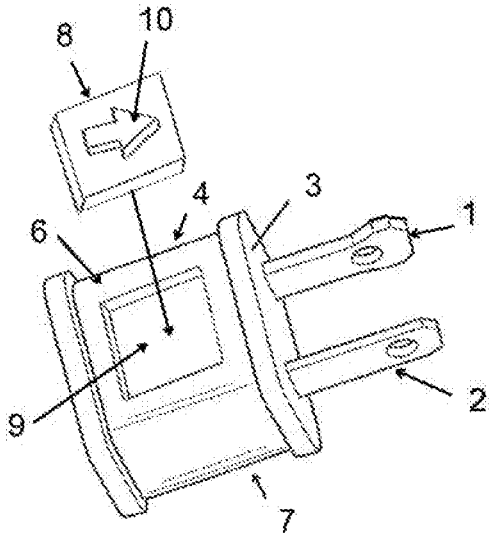
FIG. 2 is a prospective view of a modular two-prong polarized electrical plug adaptor according to one embodiment of the present invention.

FIG. 2 is a prospective view of a modular two-prong polarized electrical plug adaptor according to one embodiment of the present invention.

The plug adaptors of the present invention allow for retrofitting existing two-prong electrical plugs with the indicia of the present invention. Providing the indicial in such a retro-fitting manner assists in orienting such standard/conventional plugs with respect to polarized electrical receptacles and enables verification of proper orientation and safety of such plugs with respect to polarized electrical receptacles and outlets after the plugs are plugged into such receptacles and outlets.

Similar reference numerals are used for similar elements in FIGS. 1 and 2. The plug adaptor includes a polarized prong or blade 1 and a non-polarized prong or blade 2 extending outward from a front face 3 of the plug adaptor housing 4. The prongs or blades 1 and 2 can be made from any conventional conductive metal such as brass and the plug adaptor housing 4 can be made (e.g. molded) from any conventional non-conductive material such as a plastic material.

The top 6 and bottom 7 of the plug adaptor housing 4 can have substantially identical or similar shapes or appearances. In such cases, absent the indicia modules of the present invention, the top and bottom of the plug adaptor housing 4 can look identical or substantially identical. Further since the thicknesses and lengths of the prongs or blades 1 and 2 are the same, the entire electrical plug adaptor including the plug adaptor housing 4 and prongs or blades 1 and 2 looks virtually the same from the top and bottom planar views. As a result one cannot determine the orientation of the electrical adaptor plug of FIG. 2 as regards the polarized and non-polarized prongs or blades 1 and 2 by merely looking towards the top or bottom of the plug adaptor—absent the indicia of the present invention. Moreover absent the indicia modules of the present invention one cannot confirm that a plug adaptor that has been previously inserted into and outlet or receptacle was proper oriented for safety purposes prior to being inserted.

According to the present invention an indicia module 8 is provided which can be received and inserted into a recess 9 formed on, or in the top and bottom of the plug adaptor housing or body 4 which functions to confirm the orientation of the polarized plug adaptor both while inserting the polarized plug adaptor into a polarized outlet receptacle and to enable confirmation of proper orientation after the polarized plug adaptor has been inserted into a polarized electrical outlet or receptacle, for example when a prior user has inserted the plug adaptor into an electrical outlet or receptacle. As can be appreciated the various configurations, colors, shapes, designs, etc. of the indicia modules 8, recesses 9, surfaces of the housing or body 4 that are marked according to the present invention as described above in reference to the two-prong polarized electrical plugs are applicable to and can be used in conjunction with the plug adaptors of the present invention.

In some embodiments of the plug adaptors at least a portion of at least one or more of a side, top or bottom of the front of the body can extend further outward from a corresponding portion of a side, top or bottom of front of the body to provide a type of blocking structure that resists pivoting of the plug adaptors out of an electrical receptacle or outlet. It is within the scope of the present invention to provide extended portions that extend only from the center of the bottom, top and/or sides of the front side face of the body or from any portion(s) thereof, including providing two or more discrete extended portions spaced apart from each other along the bottom, top and/or sides of the front side face of the body.

Figure 3:
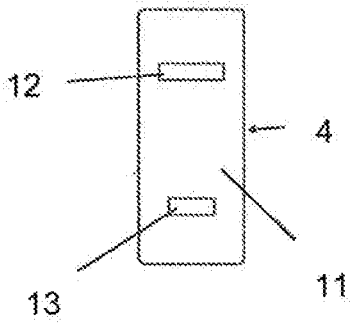
FIG. 3 is planar view of the rear face of the two-prong polarized electrical plug adaptor of FIG. 2.

FIG. 3 is planar view of the rear face of the two-prong polarized electrical plug adaptor of FIG. 2.

The back side 11 of the plug adaptor housing 4 of the plug adaptor has a polarized socket 12 and a non-polarized socket 13 formed therein which are configured to provide a female socket that can receive the prongs or blades of a standard two-prong polarized electrical plug therein. The conductive elements or contacts provided within the body 3 of the plug adaptor conductively connect the polarized socket 12 to the polarized blade or prong 3 and the non-polarized socket 13 to the non-polarized blade or prong 2. Such conductive elements or contacts can be of conventional design, for example, similar to the conductive elements or contacts found in a standard 3-prong to 2-prong plug adaptor such as model No. ACS100 sold by Eagle Aspen, and other manufactures. In alternative embodiments the female socket could be provided in a side of the plug adaptor housing that is aligned at a right angle to the front and back sides to reduce the amount of clearance space needed to use the plug adaptors.

The various shapes of the recess(es) 9 and indicia modules 8 discussed above and the various types of indicia elements 10 discussed above can be used with either of the embodiments of the present invention shown in FIGS. 1 and 2 as well as embodiments of the present invention that are understood to those skilled in the art. Also blank indicia modules can be used in the side of the plugs or plug adaptors that are not "top marked" to provide a nicer overall appearance.

Figure 4:
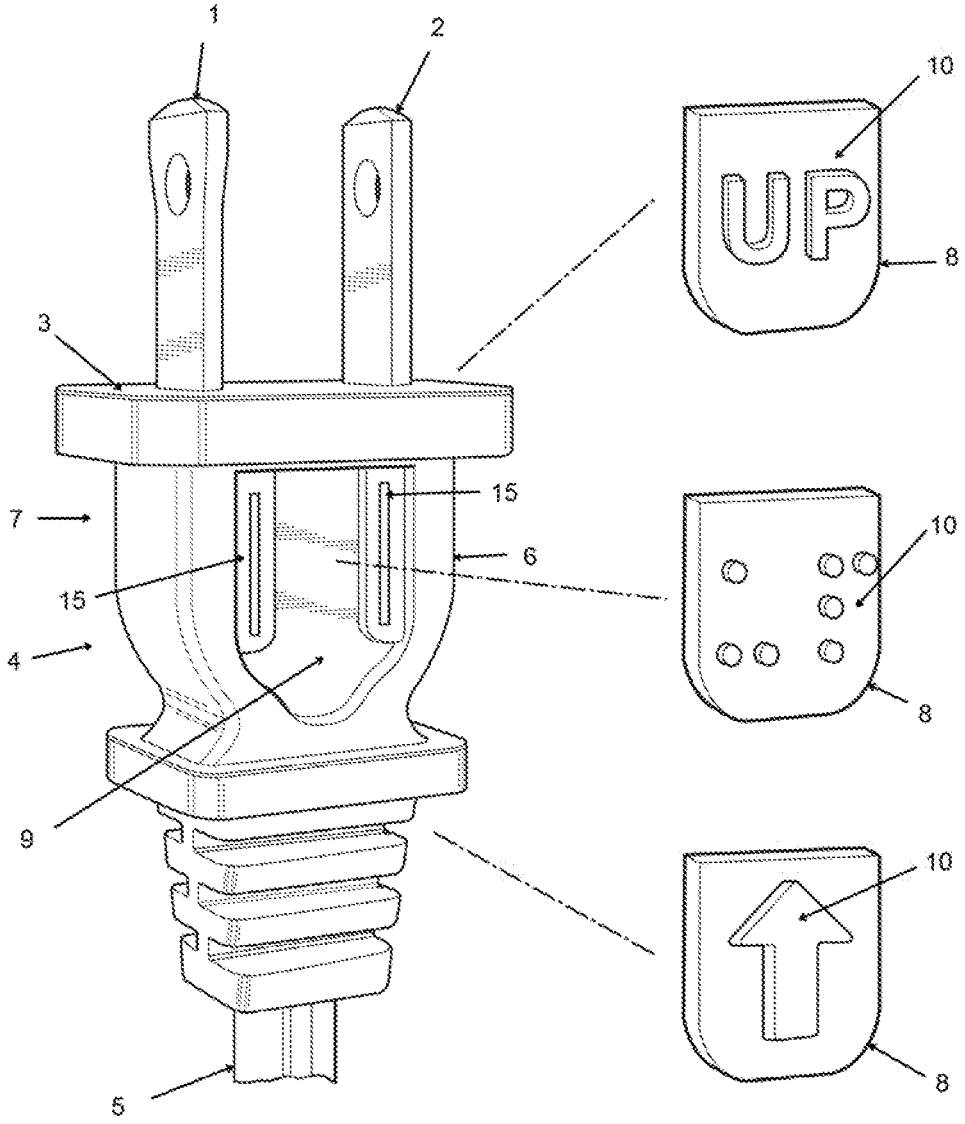
FIG. 4 is a perspective view of a modular two-prong polarized electrical plug and a set of indicia modules according to another embodiment of the present invention.
Figure 5:
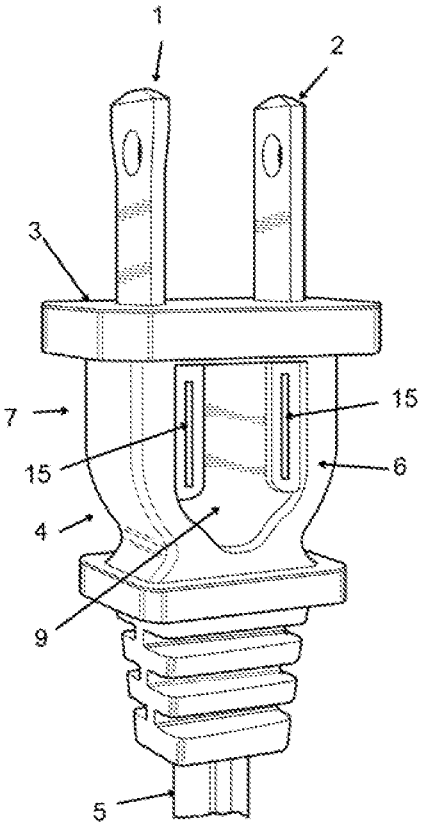
FIG. 5 is a perspective view of two-prong polarized electrical plug of FIG. 4 without an indicia module attached.
Figure 6:
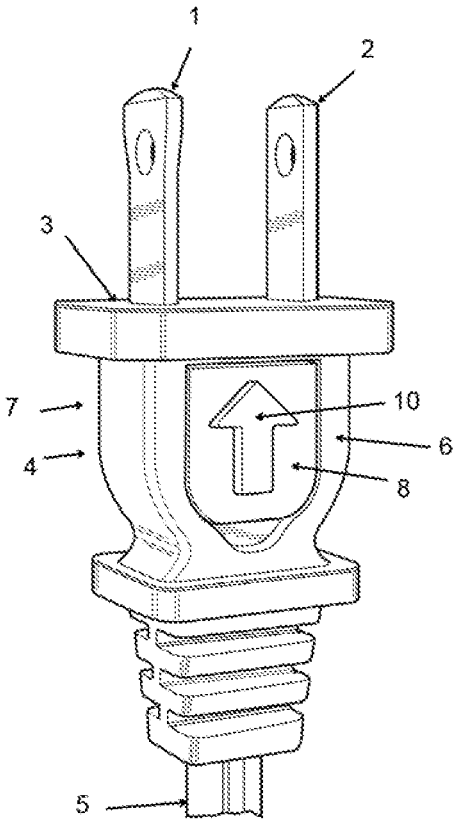
FIG. 6 is a perspective view of two-prong polarized electrical plug of FIG. 5 with an indicia module attached.

FIG. 4 is a perspective view of a modular two-prong polarized electrical plug and a set of indicia modules according to one embodiment of the present invention. FIG. 5 is a perspective view of two-prong polarized electrical plug of FIG. 4 without an indicia module attached. FIG. 6 is a perspective view of two-prong polarized electrical plug of FIG. 5 with an indicia module attached.

The two-prong polarized electrical plug shown in FIGS. 4-6 includes a polarized prong or blade 1 and a non-polarized prong or blade 2 extending outward from a front face 3 of the plug housing 4 (also referred to as plug body herein). An electrical cord 5 extends out from the rear of the plug housing 4 and can be connected to an electrical appliance or opposite to the outlet end of an extension cord (not shown). The prongs or blades 1 and 2 can be made from any conventional conductive metal such as brass and the plug housing 4 can be made (e.g. molded as a one-piece solid structure) from any conventional non-conductive material such as a plastic material. The electrical cord 5 comprises a two conductor cord with each conductor coupled to one of the polarized and non-polarized prongs or blades 1 and 2 within the plug housing 4 in a conventional manner.

The top 6 and bottom 7 of the plug housing 4 have substantially identical or similar shapes or appearances. As such, as discussed herein the indicia modules of the present invention are used to mark which of the top and bottom of the plug housing 4 will be located to face upward when the plug is plugged into or aligned to be plugged into a particular electrical outlet or receptacle that is typically mounted in a wall. Since the thicknesses and lengths of the prongs or blades 1 and 2 are the same, absent the indicia modules of the present invention, the entire electrical plug including the plug housing 4 and prongs or blades 1 and 2, looks virtually the same from the top and bottom planar views. As a result one cannot determine the orientation of the electrical plug of FIG. 1 as regards the polarized and non-polarized prongs or blades 1 and 2 by merely looking towards the top or bottom of the plug—absent the indicia modules of the present invention. Moreover absent the indicia modules of the present invention one cannot readily confirm that a plug that has been previously inserted into an outlet or receptacle was/is proper oriented for safety purposes prior to being inserted.

According to the present invention an indicia module 8 is provided which can be received and inserted into a recess 9 formed on (or in) the top (or bottom) of the plug housing 4 which functions to confirm the orientation of the polarized plug both while inserting the polarized plug into a polarized outlet receptacle and to enable confirmation of proper orientation after the polarized plug has been inserted into a polarized electrical outlet or receptacle, for example when a prior user has inserted the plug into an electrical outlet or receptacle. Reference herein to "insert," or "inserting" the indicia modules is not intended to limit how the indicia modules are coupled to the plug (or plug adaptor) housing or bodies. In this regard, as described herein the indicia modules can be received into recesses provided in or on the plug (or plug adaptor) housings or bodies, or coupled to structures that project from the plug (or plug adaptor) housings or bodies or attached on a non-recessed, non-projecting surface area of the plug (or plug adaptor) housings or bodies.

FIG. 4 includes a set of indicia modules 8, each of which can be used to mark the top of a two-prong polarized plug or plug adaptor according to the present invention. The indicia modules 8 depicted in FIG. 4 include indicia elements 10 that are in the shape of an arrow that points toward the direction where the prongs or blades 1 and 2 extend from the plug housing 4, the word "UP" and the brail equivalence for the word "up." Each of the indicia elements can be the same or a different color than the plug housing 4 so as to be easy to visually determine or recognize by most people. For example the plug housing 4 can be white and the arrow (or entire indicia module) can be red, blue, black or some other color that is easily seen when compared to another color of the plug housing. That is the plug housing can generally be one color overall such as white and the indicia can be a different color such as red, blue, black, etc. or multicolored.

The indicia element 10 can be a dyed or colored portion of the indicia module 8 that is molded with a colored insert piece or is a colored portion of the indicia module. Otherwise the indicia element 10 can be printed on, molded or coated on the indicia module 8 or provided as a permanent label, sticker, decal, or the like provided on or laminated on or in the indicia module. In one embodiment the indicia element 10 can be laminated on the surface of the indicia module 8 or laminated in a recess formed in the indicia module.

The plug housing 4 can include similar recesses 9 in both the top and bottom surfaces of the plug housing 4. In the embodiment of the invention shown in FIGS. 4-8 the recess 9 includes parallel slots 15 into which complementary parallel protrusions 16 on the back of the indicia modules 8 (See FIG. 7) are received. It is to be understood, as noted above, that the recesses can have any convenient shape, including a pattern of multiple discrete recesses 9 that receive portions, such as pins or tabs or other projecting structures of the indicia modules.

FIG. 7 is a perspective view of an indicia module according to FIGS. 4 and 6. As seen the back of the indicia module 8 includes parallel protrusion 16 which are configured to be received into the parallel slots 15 that are provided in recess 9 in FIGS. 4, 5 and 8.

The indicia modules 8 have a similar shape to the recess (s) 9 and are configured to be received into the recess. In this regard the indicia module can be press-fit into recess 9 or have any suitable engaging structure(s) along the bottom or edges to engage sufficiently in the recess 9 or cooperating structures in the recess so as not to be easily removed or fall out. In some embodiments an adhesive substance such as a glue, epoxy, etc. can be used to secure the indicia modules 8 in recesses 9. The indicia modules 8 can be molded from the same material as the plug housing 4 or otherwise manufactured of a similar or different material. Those skilled in the art will understand that any cooperating structures between the indicia modules and recesses such as press-fit, interference fit, engaging pins, etc. can be used. In alternative embodiments the recesses can be replaced with projecting structures that engage cooperating receiving structures on or in the indicia modules. In even further embodiments the recesses could be replaced with flat surface areas and the indicia modules can be permanent labels, stickers, decals, or the like that are flat or have projecting or two- or three-dimensional indicia elements that can be applied with or without additional adhesive means. Engaging structures which allow for removal of the indicia modules will allow reconfiguration of the indicia and replacement of one type/style of indicia element for another as a user may desire or to move the indicia module to the opposite side of the plug housing. As shown in FIG. 5 a small gap is provided at the bottom of the indicia module which will allow a user to easily remove the indicia module 8 as desired.

By providing the plug housing 4 and indicia modules 8 as separate elements, consumers can purchase the two-prong polarized electrical plug of FIGS. 4 and 5 and then determine what type of electrical outlet to plug the electrical plug into—one with the ground socket at the bottom or at the top—and after confirming which surface of the plug body 4 will be the "top" surface when plugged into the electrical outlet, the consumer can insert an indicia module 8 into the recess 9 that will be in the top of the plug housing 4. Further blank indicial modules that do not include indicia elements 10 (not shown) can be inserted in the recess that will be in the bottom of the plug housing 4.

As can be appreciated the present invention relieves manufacturers from having to make separate two-prong polarized electrical plus with permanent pre-affixed/provided indicia on one side or the other side of the plug housings or bodies for electrical outlets with difference ground socket configurations.

Further the present invention will avoid and overcome any mistakes consumers might make in purchasing a two-prong polarized electrical plug having permanently affixed/provided indicia on the wrong surface for a given electrical outlet configuration/orientation.

It is to be understood that the shape of the indicia elements 10 shown in FIGS. 4, 6 and 8 for non-limited illustrative purposes only and the shape of the indicia element 10 is not limited to and shapes that are shown.

In other embodiments the indicia element 10 can have any shape such as a circle, star, plus sign, etc. or be other words like "UP" or "TOP." Further the indicia element 10 can comprise any word or any symbol, logo, or pattern, including a single line or plurality of lines. In some embodiments the indicia elements 10 can be configured to provide some sense of direction required to insert a plug into an outlet. Words, arrows and non-symmetrical shaped indicia elements 10 can be used for this purpose.

The indicia elements described above can be used individually or in combination. For example indicia elements that are recessed in or project from the top surface of an indicia module can be used as well as those that are the same or a different color than the indicia module 8 or plug housing or body 4. Or a combination of an indicia element that is recessed in part and projects in part from the top surface of an indicial module could be used. These are non-limited examples of combinations that those skilled in the art can easily expand upon based upon the present description.

The indicia elements used in the present invention can be of a size and configuration to be easily seen from a distance of 6-8 feet or more which will allow one to be able to visibly verify the orientation of a plug after it has been plugged into an electrical outlet or receptacle from a standing position. In this regard if the color of the indicia and plug housing are not the same a dimension of the indicia about 5 mm or larger for a solid indicia or about 25% or greater of a corresponding dimension of the plug housing and about 33% or greater of a corresponding dimension of the plug housing will be easily visible. In the case of an indicia that is not solid, such as a line drawing or a projecting or a recessed lines or a line drawing, if the width of the lines are at least 2 mm or greater with the overall shape of any line drawing being about 25% or greater of a corresponding dimension of the plug housing and about 33% or greater of a corresponding dimension of the plug housing, or even about 50% or greater they will be easily visible. In some embodiments the overall shape of the indicia is different from the overall shape of the plug housing. In further embodiments the indicia element is laminated into or onto the indicia module or otherwise attached to the indicia module and can include two- and three-dimensional indicia. Examples of three-dimensional indicia include real and synthetic gems including gem stickers or any small three-dimensional object.

The two-prong electrical plugs and plug adaptors of the present invention are particularly safe for use by young children who will not have to be concerned with handing the prongs or blades trying to determine the polarized prong or blade from the non-polarized prong or blade. Further the use of recessed or projecting indicia can be particularly useful for persons with poor eyesight or blind and in poor lighting conditions in conjunction with electrical outlets or receptacles that are difficult to access, such as behind furniture or under tables. It is even within the scope of the present invention to provide brail as indicia.

FIG. 8 is perspective view of a modular two-prong polarized electrical plug adaptor and an indicia module according to one embodiment of the present invention.

As discussed above, the plug adaptors of the present invention allow for retrofitting existing two-prong electrical plugs with the indicia of the present invention. Providing the indicia in such a retro-fitting manner assists in orienting such standard/conventional plugs with respect to polarized electrical receptacles and enables verification of proper orientation and safety of such plugs with respect to polarized electrical receptacles and outlets after the plugs are plugged into such receptacles and outlets.

Similar reference numerals are used for similar elements in FIGS. 4 and 8. The plug adaptor includes a polarized prong or blade 1 and a non-polarized prong or blade 2 extending outward from a front face 3 of the plug adaptor housing 4. The prongs or blades 1 and 2 can be made from any conventional conductive metal such as brass and the plug adaptor housing 4 can be made (e.g. molded) from any conventional non-conductive material such as a plastic material.

The top 6 and bottom 7 of the plug adaptor housing 4 can have substantially identical or similar shapes or appearances. In such cases, absent the indicia modules of the present invention, the top and bottom of the plug adaptor housing 4 can look identical or substantially identical. Further since the thicknesses and lengths of the prongs or blades 1 and 2 are the same, the entire electrical plug adaptor including the plug adaptor housing 4 and prongs or blades 1 and 2 looks virtually the same from the top and bottom planar views. As a result one cannot determine the orientation of the electrical adaptor plug of FIG. 8 as regards the polarized and non-polarized prongs or blades 1 and 2 by merely looking towards the top or bottom of the plug adaptor—absent the indicia of the present invention. Moreover absent the indicia module of the present invention one cannot confirm that a plug adaptor that has been previously inserted into and outlet or receptacle was proper oriented for safety purposes prior to being inserted.

According to the present invention an indicia module 8 is provided which can be received and inserted into a recess 9 formed on, or in the top and bottom of the plug adaptor housing or body 4 which functions to confirm the orientation of the polarized plug adaptor both while inserting the polarized plug adaptor into a polarized outlet receptacle and to enable confirmation of proper orientation after the polarized plug adaptor has been inserted into a polarized electrical outlet or receptacle, for example when a prior user has inserted the plug adaptor into an electrical outlet or receptacle. As can be appreciated the various configurations, colors, shapes, designs, etc. of the indicia modules 8, recesses 9, surfaces of the housing or body 4 that are marked according to the present invention as described above in reference to the two-prong polarized electrical plugs are applicable to and can be used in conjunction with the plug adaptors of the present invention.

In some embodiments of the plug adaptors at least a portion of at least one or more of a side, top or bottom of the front of the body can extend further outward from a corresponding portion of a side, top or bottom of front of the body to provide a type of blocking structure that resists pivoting of the plug adaptors out of an electrical receptacle or outlet. It is within the scope of the present invention to provide extended portions that extend only from the center of the bottom, top and/or sides of the front side face of the body or from any portion(s) thereof, including providing two or more discrete extended portions spaced apart from each other along the bottom, top and/or sides of the front side face of the body.

As in the embodiment shown in FIG. 3, the back side of the plug adaptor housing 4 of the plug adaptor has a polarized socket and a non-polarized socket formed therein which are configured to provide a female socket that can receive the prongs or blades of a standard two-prong polarized electrical plug therein. The conductive elements or contacts provided within the body 3 of the plug adaptor conductively connect the polarized socket to the polarized blade or prong 3 and the non-polarized socket to the non-polarized blade or prong 2. Such conductive elements or contacts can be of conventional design, for example, similar to the conductive elements or contacts found in a standard 3-prong to 2-prong plug adaptor such as model No. ACS100 sold by Eagle Aspen, and other manufactures. In alternative embodiments the female socket could be provided in a side of the plug adaptor housing that is aligned at a right angle to the front and back sides to reduce the amount of clearance space needed to use the plug adaptors.

The various shapes of the recess(es) 9 and indicia modules 8 discussed above and the various types of indicia elements 10 discussed above can be used with either of the embodiments of the present invention shown in FIGS. 4-8 as well as embodiments of the present invention that are understood to those skilled in the art. Also blank indicia modules can be used in the side of the plugs or plug adaptors that are not "top marked" to provide a nicer overall appearance.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. A modular polarized electrical plug adaptor configured to be coupled to a polarized two-prong electrical plug, wherein the polarized electrical plug adaptor provides for visual confirmation of proper orientation with respect to a wall mounted polarized electrical receptacle or outlet before and after the modular polarized electrical plug adaptor is plugged into the wall mounted polarized electrical receptacle or outlet, the polarized electrical plug adaptor comprises:

a body having a top and a bottom and a front and a back;

an electrically conductive polarized prong or blade that extends outward from the front of the body; an electrically conductive non-polarized prong or blade that extends outward from the front of the body;

a polarized socket provided in the back of the body;

a non-polarized socket provided in the back of the body, said polarized socket and non-polarized socket being configured to receive a two-prong polarized electrical plug therein;

electrical conductive elements within the body that connect the polarized socket to the polarized prong or blade and connect the non-polarized socket to the non-polarized prong or blade;

indicia module receiving structures provided on both the top and bottom of the body; and an indicia module having an indicia element provided thereon which indicia module is configured to be attached to one of either of the indicia module receiving structures provided on the top and bottom of the body.

2. A modular polarized electrical plug adaptor according to claim 1, wherein the receiving structures provided on both the top and bottom of the plug body comprise recesses formed in the top and bottom of the plug housing.

3. A modular polarized electrical plug adaptor according to claim 1, wherein the receiving structures provided on both the top and bottom of the plug body comprise flat portions.

4. A modular polarized electrical plug adaptor according to claim 1, wherein the indicia element has a three-dimensional shape.

5. A modular polarized electrical plug adaptor according to claim 1, wherein the indicia element is a different color than that plug body.

6. A modular polarized electrical plug adaptor according to claim 1, wherein the indicia element comprises one of a geometric shape, anon-geometric shape, a symbol, a logo, a pattern and a word.

* * * * *